US009272719B2

(12) United States Patent
Brandt

(10) Patent No.: US 9,272,719 B2
(45) Date of Patent: Mar. 1, 2016

(54) RATCHETING RAILCAR INDEXER

(71) Applicant: Calbrandt, Inc., Delano, MN (US)

(72) Inventor: Calvin J. Brandt, Delano, MN (US)

(73) Assignee: Calbrandt, Inc., Delano, MN (US)

( * ) Notice: Subject to any disclaimer, the term of this patent is extended or adjusted under 35 U.S.C. 154(b) by 151 days.

(21) Appl. No.: 14/033,841

(22) Filed: Sep. 23, 2013

(65) Prior Publication Data

US 2015/0083017 A1 Mar. 26, 2015

(51) Int. Cl.
*B61J 3/08* (2006.01)

(52) U.S. Cl.
CPC ..... *B61J 3/08* (2013.01)

(58) Field of Classification Search
CPC ..... B61J 3/00; B61J 3/02; B61J 3/04; B61J 3/06; B61J 3/08; B61J 3/10; B61J 3/12
See application file for complete search history.

(56) References Cited

U.S. PATENT DOCUMENTS

| | | | | |
|---|---|---|---|---|
| 5,709,153 | A * | 1/1998 | Brandt | 104/162 |
| 6,006,673 | A * | 12/1999 | Brandt | 104/162 |
| 6,267,059 | B1 * | 7/2001 | Brandt | 104/162 |
| 6,837,168 | B1 * | 1/2005 | Goldbeck et al. | 104/162 |
| 7,934,457 | B2 | 5/2011 | Brandt | |
| 2002/0007760 | A1 * | 1/2002 | Brandt | 104/182 |
| 2007/0251406 | A1 * | 11/2007 | Brandt | 104/27 |
| 2010/0258025 | A1 * | 10/2010 | Brandt | 104/162 |
| 2014/0261056 | A1 * | 9/2014 | Goldbeck | 104/162 |
| 2015/0083017 | A1 * | 3/2015 | Brandt | 104/162 |

* cited by examiner

*Primary Examiner* — Jason C Smith
(74) *Attorney, Agent, or Firm* — Nikolai & Merserau, P.A.; C. G. Mersereau

(57) ABSTRACT

A railcar handling system is disclosed that includes an indexing unit having a plurality of dog carriages, serially aligned in fixed spaced relation, each carriage carrying a railcar axle-engaging dog and a railcar wheel sensor and a hydraulic operating system including a hydraulic cylinder for moving the plurality of dog carriages in unison in a reciprocating ratcheting manner and operating said axle-engaging dogs. A control system is provided to coordinate the operation of the railcar handling system.

7 Claims, 6 Drawing Sheets

RATCHETING RAILCAR INDEXER

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to trackside or in track railway car handling equipment for positioning railcars along a track for loading or unloading operations. More particularly, the present invention relates to a ratcheting train positioning system that employs a tandem dog carriage arrangement between the rails that enables force to be applied serially by one dog at a time to consecutive railcar trucks to move a string of railcars to position consecutive railcars for loading or unloading without exceeding the maximum force allowable on any one railcar.

II. Related Art

Freight-hauling railway cars need to be precisely positioned proximate freight or cargo handling equipment to undergo loading and unloading operations. Freight in the form of bulk cargo such as grain is typically loaded or unloaded with reference to stationary freight handling equipment such as chutes and conveyor equipment situated at fixed locations above or in pits beneath a specific dedicated portion of the track. Railcars for transporting grain or other such finely divided dry bulk agricultural commodities may be covered and designed with a plurality of spaced bottom discharge hopper bins or chutes accessing the main cargo storage volume. The chutes are closed by capstan-operated rack and pinion bottom closure gate systems.

In the loading and discharge operations, a connected engine roughly positions one end of a string of cars to be loaded or unloaded beneath or above the appropriate equipment at the desired fixed location. Because locomotives are not well suited for precisely positioning individual cars or even strings of cars along a railroad track, positioning devices known as train movers or positioners are located at fixed stations along the track. The positioning devices generally employ heavy pushing members known as railcar-engaging "dogs" to move the cars into position.

Positioning devices generally classified in the industry as "indexers" position railcars using dogs to push against railcar bogey frames or axles. Bogey frame indexers may employ dogs carried by a pair of carriages operating along indexer tracks on built-in guideways located on opposite sides of associated track rails. Indexers are designed so that the carriages and associate dogs on both sides of the track are coordinated to operate together in unison to engage and move a car or string of cars along the track. Thus, in indexer type bogey frame-engaging positioning devices, dogs on opposite sides of the track are caused to engage the bogey frame during the same stroke to thereby provide a balanced force by pushing against both of the spaced sides of the truck bogey frame simultaneously. Axle-type indexers include carriages operated between the tracks that employ a single central dog to engage truck axles rather than bogey frames. The indexer system of the invention is an axle-type indexer.

While each type of railcar indexer has certain advantages, an axle system does not require guideways located outside the track rails and can conveniently be used with automated railcar discharge gate equipment, for example. The use of a single, centrally located guideway simplifies the system and it would be even more advantageous if the system could be operate using a single hydraulic cylinder in a ratcheting manner to advance a string of cars.

SUMMARY OF THE INVENTION

By means of the present invention, there is provided a ratcheting railcar handling system in the form of a railcar axle-engaging system that includes an indexing unit that has a plurality of aligned, sequentially positioned, spaced dog carriages, each dog carriage carrying a railcar axle-engaging dog and a railcar wheel sensor. A hydraulic operating system including a hydraulic cylinder for moving the aligned, sequentially positioned, spaced dog carriages in unison in a reciprocating manner and operating the axle-engaging dogs is provided.

In a preferred embodiment, the railcar handling system includes three dog carriages connected in a fixed series that operate along a central guiderail between the rails and move and position railcars in a string of cars in a nine-step operating sequence. The single operating hydraulic cylinder coordinates with railcar wheel sensors associated with each dog carriage to seek sequential railcar trucks and full axles in a ratcheting fashion to position cars precisely for loading or unloading operations according to a controls operating sequence.

In operation, the system sequentially "ratchets" a string of attached cars employing wheel sensors and sequential use of dogs to move the cars in discreet steps and accomplish sequential placement of the cars for loading or unloading operations.

DETAILED DESCRIPTION

The following detailed description is directed to one or more embodiments of the invention which are presented as examples and are not intended to limit the scope of the invention in any way as variations that are within the scope of the inventive concepts may occur to those skilled in the art.

Terms such as "left, right, first, second, third, front, middle, rear, up, down, horizontal, vertical" are arbitrary or general terms taken in connection with the figures and should not be construed as absolute terms with respect to an actual system.

Figure 1A:
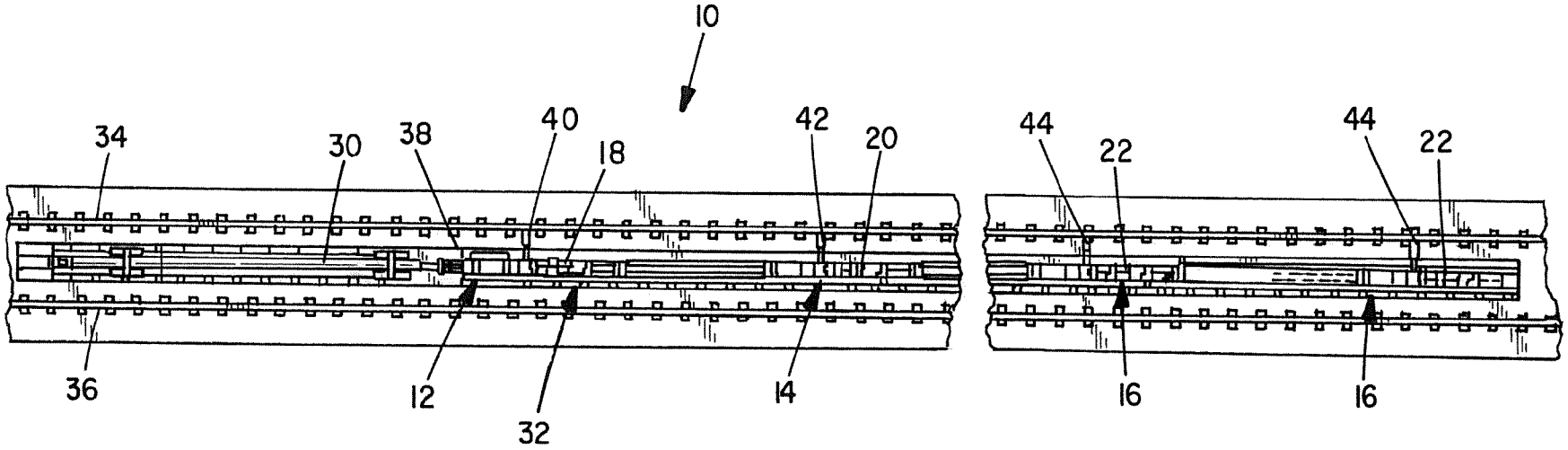
FIG. 1A is a general schematic plan or layout view of an indexer system in accordance with the invention.

FIG. 1A shows a schematic plan layout view of an axle-engaging indexer in accordance with the invention. The indexer system shown generally at 10, includes three identical dog carriage units, including a lead or front carriage unit 12, a middle or second dog carriage unit 14 and a rear or third dog carriage unit 16. The dog carriage units each carry a single, heavy, axle-engaging dog member. The dog members are designated 18, 20 and 22, respectively. The dog carriages are fixed together in tandem and spaced by connecting members 24 and 26. The carriages are operated by a connected hydraulic system that includes a main operating cylinder 30 connected to the front carriage 12. A cylinder for use in the design of the illustrated embodiment is a double-acting hydraulic cylinder having a 6½ inch bore, a 4 inch diameter rod and a 19 foot stroke. It will be appreciated that the stroke length of the cylinder and length of connecting members 24 and 26, which determine carriage separation, will vary with the length of the railcars to be processed by the system. The illustrated system is designed for a maximum car length of 65'-0½". The rear dog carriage is shown in two positions to illustrate the travel of a full hydraulic cylinder stroke. Hydraulic fluid is supplied to the dog carriages along with the cylinder to operate the dogs in a well-known manner. Thus, the dogs are manually spring-biased in a down position and hydraulic fluid pressure is used to overcome the spring force to raise the dogs as required.

As shown, the indexer system of the present invention is operated along a guideway 32 which is mounted between rails 34 and 36. A full retract proximity switch, which indicates the end of a full pull stroke, is shown at 38. A front carriage wheel sensor is shown at 40, a middle carriage wheel sensor is shown at 42 and a rear carriage wheel sensor is shown at 44.

Figure 1B:
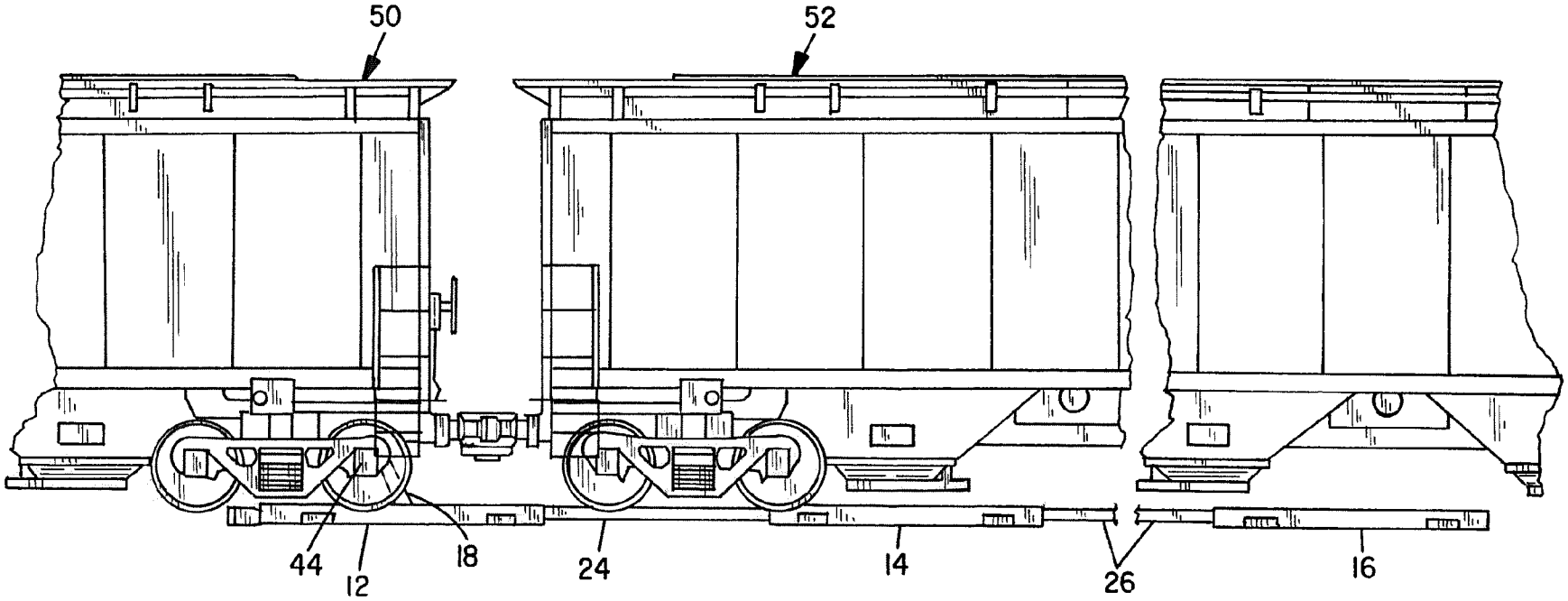
FIG. 1B is a partial schematic side elevational view of the layout of FIG. 1A, including parts of several railcars.

FIG. 1B shows partial side elevational views of railcars 50 and 52 with dog 18 of front carriage 12 raised and addressing the last axle 54 of railcar 50.

Figure 2:
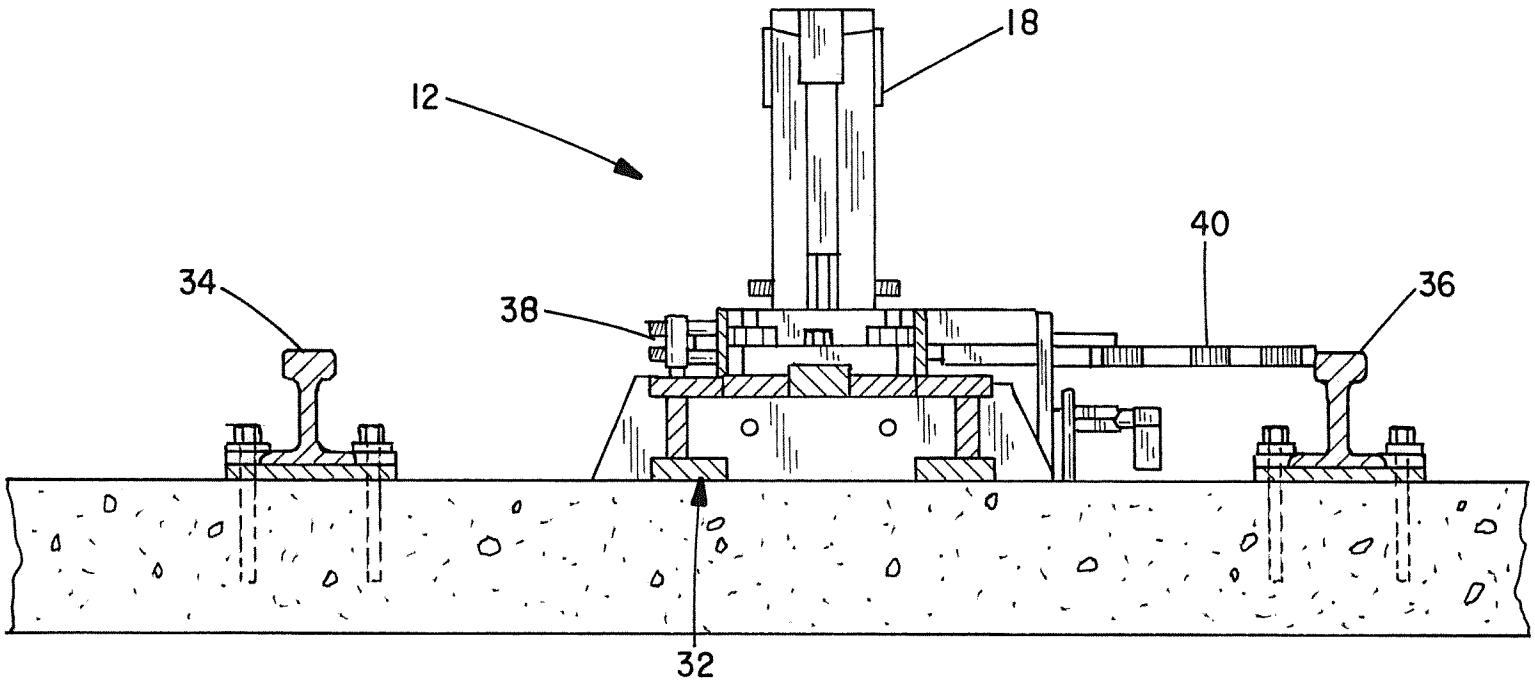
FIG. 2 is a rear elevational view of a dog carriage for use in the indexer of the invention.

FIG. 2 shows a rear elevational schematic view of dog carriage 12 of the invention showing the dog member 18 in the raised position.

Figure 3A:
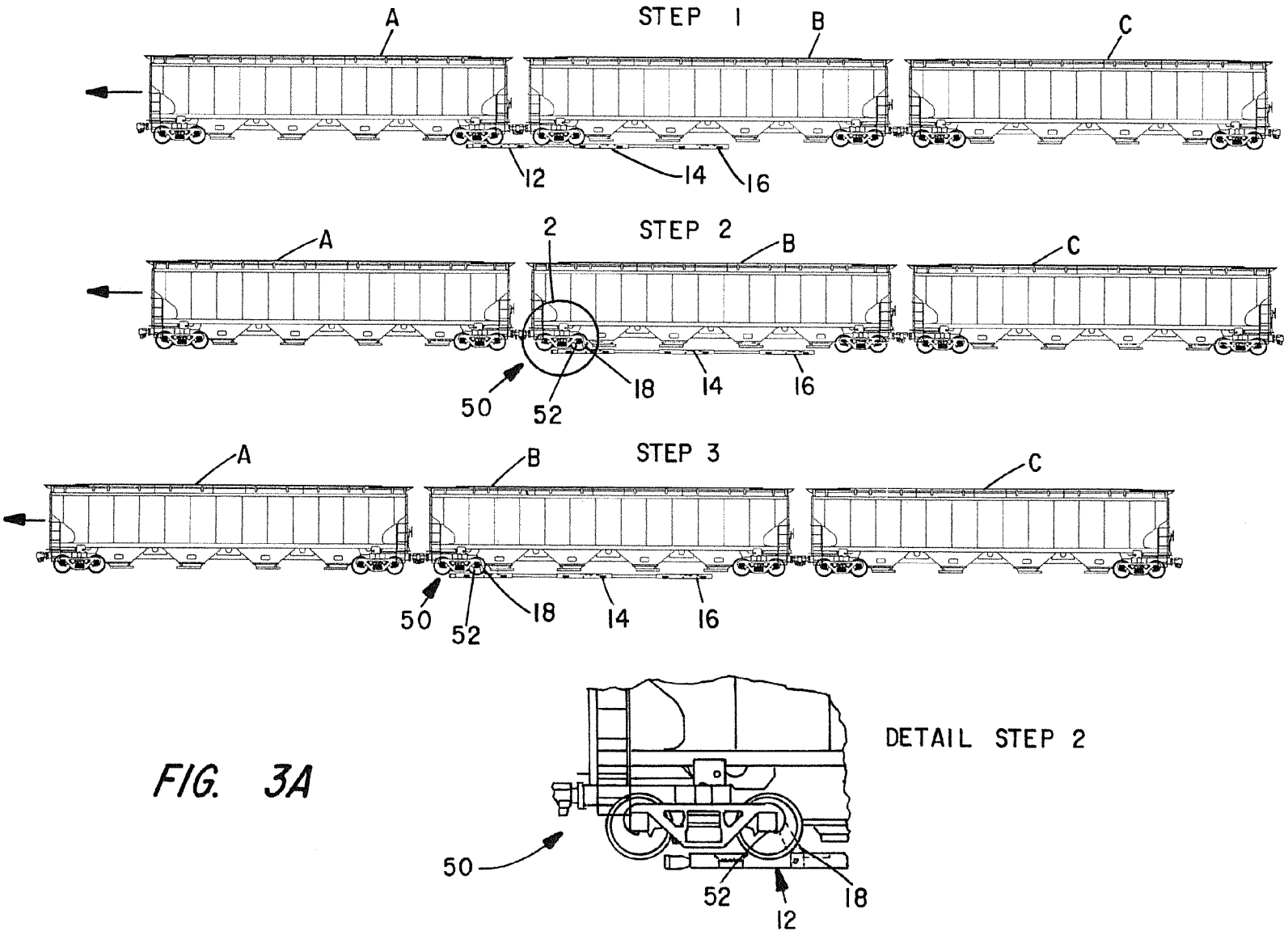
FIGS. 3A, 3B and 3C depict a ratcheting axle indexer operating sequence.
Figure 3B:
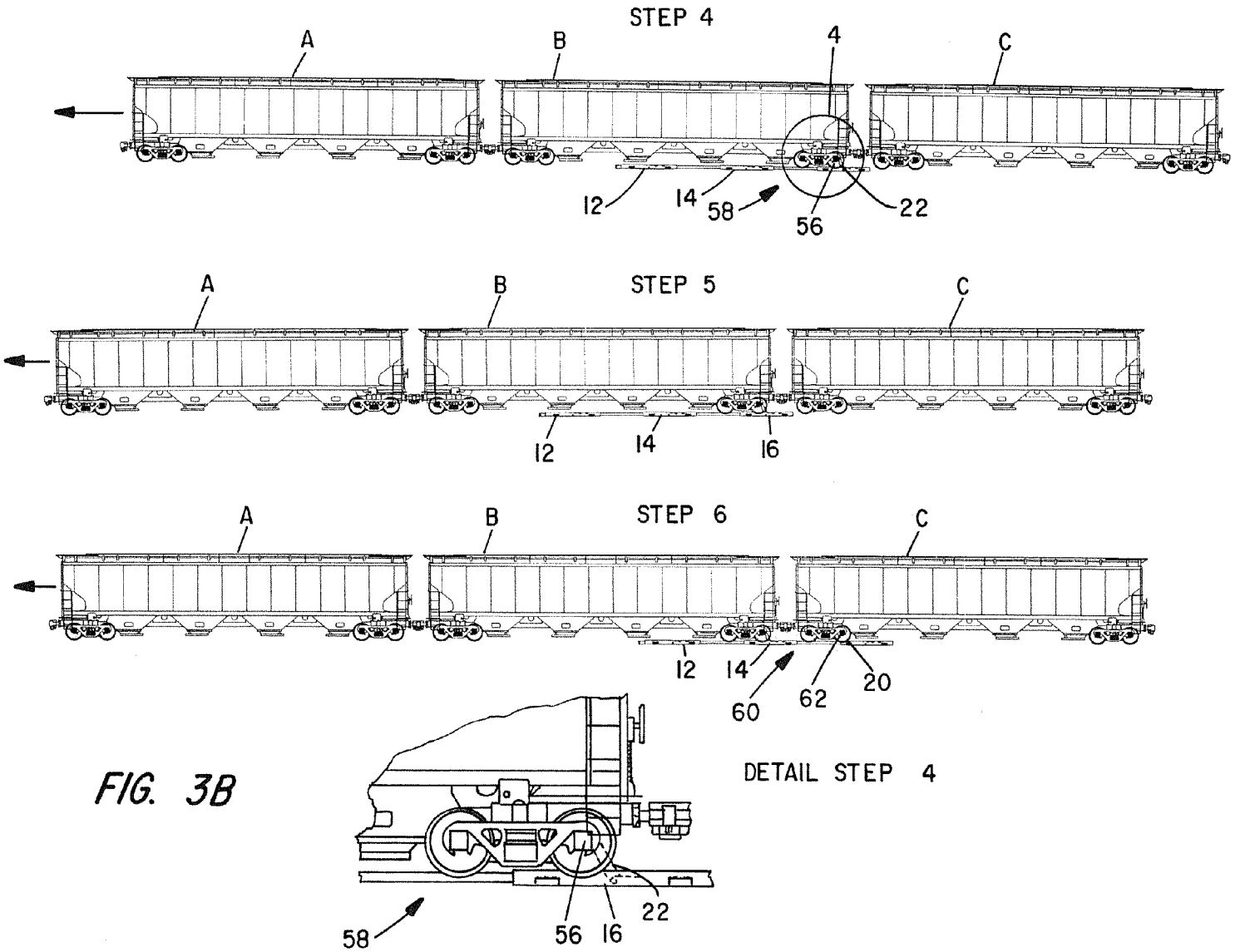
Figure 3C:
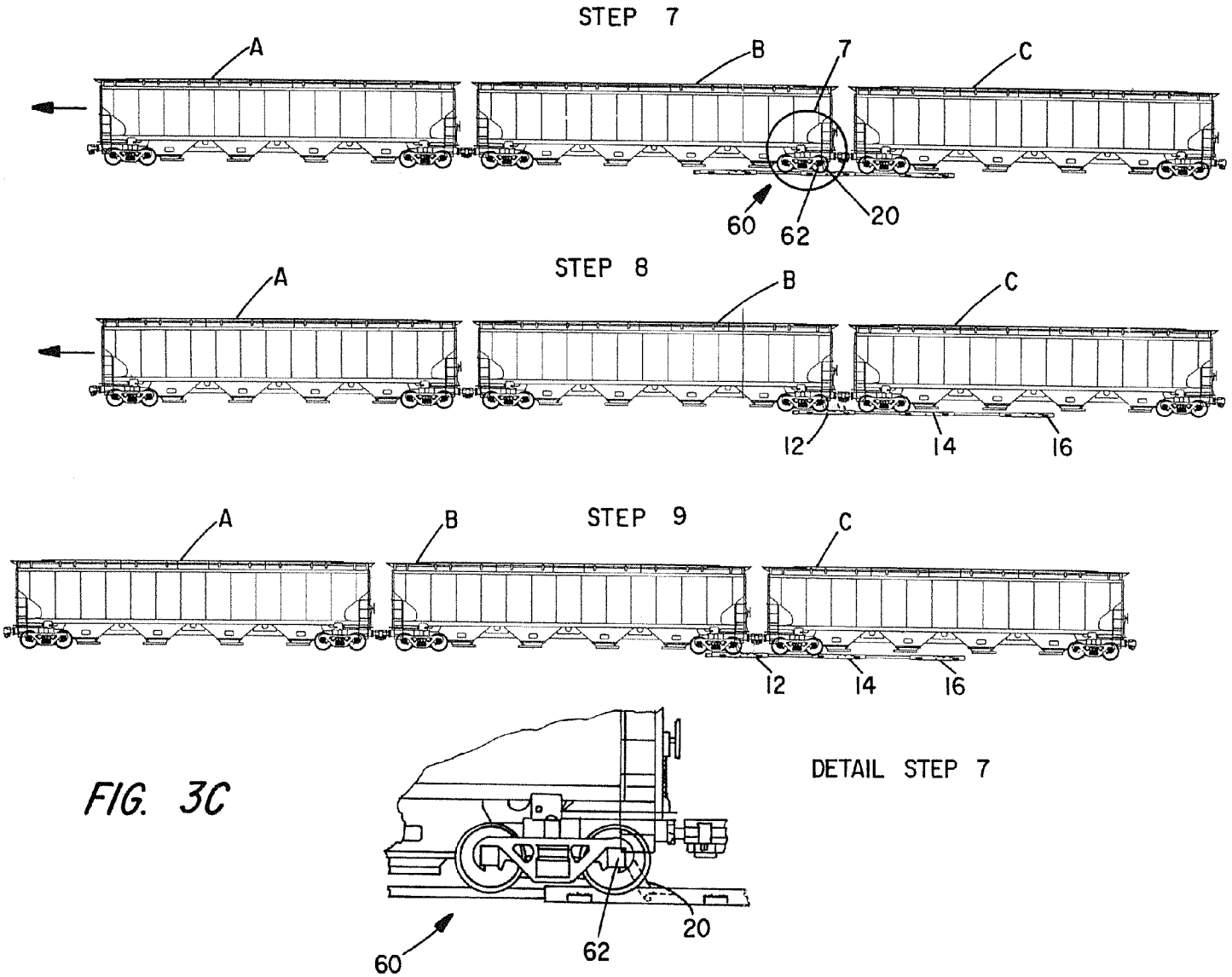

FIGS. 3A-3C depict nine steps in the operation of the indexer system of the invention to move a string or trip of cars one position from right to left in the illustrated figures. In the initial upper view of FIG. 3A, there are three aligned railcars A, B and C pictured with a schematic of the indexer carriages of the invention. In the initial view or step 1, the schematic representation of the indexer system is shown fully retracted with the axle engaging dogs in the retracted or down position. Railcar A is presumed to be located in position to be loaded or unloaded and the sequence of steps is designed to "ratchet" railcar B into the position of railcar A. This sequence can then be repeated until all the connected cars have been processed.

In step 2, the cylinder 30 has been extended and the front carriage wheel sensor has found the truck 50 and the correct second wheel and, in response, the front carriage dog 18 has been raised to contact axle 52 of the front truck of railcar B as shown in detail 2.

In step 3, the cylinder is fully retracted with dog 18 remaining engaged to and pulling axle 52 of railcar B causing the cars to move the length of the retraction stroke to the left as pulled by the front carriage dog 18.

In step 4 of FIG. 3B, with the cars positioned as after step 3, the cylinder is again extended with all of the dogs in the down position and the rear carriage wheel sensor 44 is activated to seek the rear wheel of the rear truck of railcar B at which time rear carriage dog 22 is raised to engage axle 56 of rear truck 58 of railcar B. This is shown in detail 4. In step 5, the operative cylinder is again fully retracted moving the cars another step to the left. Step 6 involves again extending the cylinder with the dogs down and, in this step, the middle carriage wheel sensor is activated to find the front truck 60 of car C and the dog 20 is raised to contact the rear axle 62 of the truck 60. Thus, the system has now moved to engage railcar C in the manner that railcar B was engaged in step 2.

In FIG. 3C, the final steps of the sequence 7-9 are pictured. In step 7, the cylinder is again fully retracted and the railcars again are moved or "ratcheted" to the left. In step 8, the front carriage wheel sensor is again activated and the cylinder extended with the dogs down until the front wheel sensor detects the rear wheel of the truck 60 and the front carriage dog 18 is raised to pull against axle 62. In step 9, the cylinder retracts pulling the cars a final ratchet step to the left such that after three steps to the left, railcar B is positioned at the spot formerly occupied by railcar A and it can now be loaded or unloaded. The sequence can be repeated to sequentially present all the cars in a string of cars to be processed in a like manner.

The typical indexer system in accordance with the invention exerts a pulling effort of about 50,000 pounds, but systems can be produced that exert up to the present axle limit of 75,000 pounds. Typical speeds are about 50 feet per minute (FPM) extend speed and about 25 feet per minute for a power stroke retract speed. The illustrated system may operate using a pressure of about 2400-2500 psi retract pressure and about 800 psi extend pressure. An automatic dog lock-down system is employed during the "extend" steps and well-known valving is provided to selectively raise designated dogs in response to wheel sensing signals as the operation steps are followed. Wheel sensors may be wireless sensors such as those obtainable from Honeywell. Full stroke indicating switches may be hardwired in the guideway. The entire operation can be controlled by a connected system, including a connected microprocessor in a wired or wireless system such that a car moving sequence is automated.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A railcar handling system comprising:

(a) a guideway mounted between rails of a railroad track, an indexing unit designed to operate along said guideway, said indexing unit including a plurality of aligned, sequentially positioned dog carriages connected in spaced relation, each carriage carrying a railcar axle-engaging dog and a railcar wheel sensor;

(b) a hydraulic operating system including a hydraulic cylinder for moving said plurality of aligned sequentially positioned, spaced dog carriages in unison in a reciprocating manner and operating said axle-engaging dogs; and (c) a sequencing control system for coordinating said wheel sensors, dog raising and downing, and cylinder operation.

2. A railcar handling system as in claim 1 comprising three dog carriages connected in series.

3. A railcar handling system as in claim 1 wherein the hydraulic operating system includes a single main double-acting hydraulic cylinder for moving said dog carriages.

4. A railcar handling system as in claim 2 wherein the hydraulic operating system includes a single main double-acting hydraulic cylinder for moving said dog carriages.

5. A railcar handling system as in claim 1 further comprising connecting members fixing the relative separation position of the dog carriages.

6. A railcar handling system as in claim 1 wherein said wheel sensors are wireless sensors.

7. A railcar handling system as in claim 1 wherein said control system further comprises an automatic dog lock-down system.

* * * * *